US007416458B2

(12) United States Patent
Suemori et al.

(10) Patent No.: US 7,416,458 B2
(45) Date of Patent: Aug. 26, 2008

(54) CONTROLLER FOR PROPULSION UNIT, CONTROL PROGRAM FOR PROPULSION UNIT CONTROLLER, METHOD OF CONTROLLING PROPULSION UNIT CONTROLLER, AND CONTROLLER FOR WATERCRAFT

(75) Inventors: Masaru Suemori, Shizuoka-ken (JP); Takashi Okuyama, Shizuoka-ken (JP)

(73) Assignee: Yamaha Motor Co., Ltd., Shizuoka (JP)

( * ) Notice: Subject to any disclaimer, the term of this patent is extended or adjusted under 35 U.S.C. 154(b) by 310 days.

(21) Appl. No.: 11/126,872

(22) Filed: May 11, 2005

(65) Prior Publication Data

US 2005/0263058 A1 Dec. 1, 2005

(30) Foreign Application Priority Data

May 11, 2004 (JP) ..... 2004-141483

(51) Int. Cl.

| | |
|---|---|
| ***B63H 5/20*** | (2006.01) |
| *B63H 21/22* | (2006.01) |
| *B63H 25/04* | (2006.01) |
| *B60W 10/04* | (2006.01) |

(52) U.S. Cl. ..... 440/53; 440/1; 440/84; 114/144 R

(58) Field of Classification Search ..... 114/144 R; 440/1

See application file for complete search history.

(56) References Cited

U.S. PATENT DOCUMENTS

| | | | | |
|---|---|---|---|---|
| 5,386,368 | A * | 1/1995 | Knight | 701/116 |
| 5,931,110 | A * | 8/1999 | Yamamoto | 114/144 E |
| 6,234,853 | B1 * | 5/2001 | Lanyi et al. | 440/53 |
| 6,659,815 | B2 * | 12/2003 | Motsenbocker | 440/1 |
| 6,855,020 | B2 * | 2/2005 | Kaji | 440/84 |
| 2004/0254727 | A1 * | 12/2004 | Ockerse et al. | 701/224 |
| 2006/0160440 | A1 * | 7/2006 | Ishida et al. | 440/87 |
| 2007/0049136 | A1 * | 3/2007 | Bremsjo | 440/1 |

FOREIGN PATENT DOCUMENTS

| | | |
|---|---|---|
| JP | 2810087 | 7/1998 |
| JP | 2003-026095 | 1/2003 |

* cited by examiner

*Primary Examiner*—Lars A Olson
*Assistant Examiner*—Daniel V Venne
(74) *Attorney, Agent, or Firm*—Knobbe, Martens, Olson & Bear, LLP

(57) ABSTRACT

A boat control system can include a propulsion unit controller, a port outboard motor, and a starboard outboard motor. The propulsion unit controller can includes an electronic throttle valve control section, an electronic shift control section, an electronic steering control section, a target control value calculating section, and a GPS receiver. The target control value calculating section can be adapted to calculate engine revolutions and steering angles corresponding to target values of the port outboard motor and the starboard outboard motor based on target values preset by an operator and values detected by the GPS receiver.

18 Claims, 10 Drawing Sheets

(a)

(b)

(a)

(b)

| | | 1st quadrant (>0) | | 2nd quadrant (<0) | | 3rd quadrant (<0) | | 4th quadrant (>0) | |
|---|---|---|---|---|---|---|---|---|---|
| Input | Jz | | | | | | | | |
| | $\psi-\psi 0$ | + | (−) | + | (−) | + | (−) | + | (−) |
| Output | Lateral swings | Small | (Great) | Great | (Small) | Great | (Small) | Small | (Great) |
| | $\delta L$ | + | (−) | − | (+) | − | (+) | + | (−) |
| | $\delta R$ | − | (+) | + | (−) | + | (−) | − | (+) |
| | NL | +Great | (+Great) | -Small | (-Small) | -Great | (-Great) | +Small | (+Small) |
| | NR | -Small | (-Small) | +Great | (+Great) | +Small | (+Small) | -Great | (-Great) |

| Jz | FR0900 |
|---|---|
| 0~15 | PR0900 |
| 15~30 | PR0901 |
| 30~45 | PR0902 |
| 45~60 | PR0903 |
| 60~75 | PR0904 |
| 75~90 | PR0905 |
| 90~105 | PR0906 |
| 105~120 | PR0907 |
| 120~135 | PR0908 |
| 135~150 | PR0909 |
| 150~165 | PR0910 |
| 165~180 | PR0911 |

CONTROLLER FOR PROPULSION UNIT, CONTROL PROGRAM FOR PROPULSION UNIT CONTROLLER, METHOD OF CONTROLLING PROPULSION UNIT CONTROLLER, AND CONTROLLER FOR WATERCRAFT

PRIORITY INFORMATION

This application is based on and claims priority under 35 U.S.C. § 119 to Japanese Patent Application No. 2004-141483, filed on May 11, 2004, the entire contents of which is hereby expressly incorporated by reference.

BACKGROUND OF THE INVENTION

1. Field of the Invention

The present inventions relate to watercraft control, more particularly to a controller for a propulsion unit, a control program for a propulsion unit controller, a method of controlling a propulsion unit controller, and a controller for watercraft operation, which can be used for controlling a plural number of propulsion units of a watercraft.

2. Description of the Related Art

Methods of facilitating boat handling have been conventionally proposed to direct a boat in any intended direction while holding the bow direction or bow turning speed constant. Such an operation can be accomplished by utilizing geometric relationships among positions of the instantaneous boat center and plural propulsion units, and resultant vector of propulsion forces. These methods provide the effect of facilitating approach to or departure from a pier, which can be difficult, for example, in rough water.

In most of the proposed methods, at least one propulsion unit is mounted on the stern of the watercraft. A plurality of small propulsion units, commonly known as "side thrusters" are mounted on the bow or other locations on the boat. Using the geometric relationships as described, propulsion forces are appropriately adjusted to run the boat in any intended direction while holding constant the bow direction or bow turning speed.

Application of such proposed methods to a small boat results in many disadvantages such as increase in cost due to the additional hardware including the side thrusters, changes in shape for securing mounting positions, and deterioration in fuel economy due to increase in hydrodynamic resistance generated by the side thrusters.

Other proposed methods include using a boat is with two propulsion units, one each at port stern and starboard stern. In these methods, the boat can be moved in any intended direction by controlling propulsion forces appropriately while keeping the bow direction or bow turning speed constant. This method utilizes the geometric relationships among positions of the instantaneous boat center and the plural propulsion units, as well as the resultant vector of propulsion forces to obtain the same effects without the disadvantages associated with the above method using the side thrusters.

For example, the Japanese Patent Application Publication JP-B-2810087 discloses an invention related to a mechanism for appropriately handling the resultant vector of propulsion forces produced with port and starboard propulsion units.

Other methods for controlling a watercraft position have also been proposed. For example, because anchoring is not possible in deep water, such as in the open ocean, boaters who wish to maintain a fixed position typically periodically restart and drive the boat to compensate for drift. Alternatively, when fishing, the engine can be left running but disengaged, i.e., in neutral, so that the boat is allowed to drift slowly from a starting point. When the boat drifts a certain distance from the start point, the engine is engaged to return the boat back to the start point, and again disengaged to drift. This operation is repeated.

In a form of troll fishing, the boat is required to drift slowly with the bow preferably directed toward the wind. Leisure fishing boats having only one shaft IB can be held in such a position by relying on the main keel of the hull and a spanker (sail) on the stern. Such an arrangement is disclosed in Japanese Examined Patent Application Publication JP-A-2003-26095.

SUMMARY OF THE INVENTION

When the above-noted techniques are used with a small boat propelled with plural outboard motors, various problems arise because such small boats typically do not have a substantial keel, the outboard motors are at the stern, and such boats can have a larger upper structure. If the engine of such a boat is disengaged to the neutral position in deep water where the boat cannot be anchored, the boat drifts faster in comparison with boats of different configurations, and the bow ends up in being directed leeward. Therefore, the above-noted version of troll fishing is difficult to practice in such small boats.

Thus, in accordance with an embodiment, a controller for a propulsion unit on a boat for controlling propulsion units, at least one unit provided at the port stern and at least one unit provided at the starboard stern of the boat. The controller can comprise a target moving direction information acquiring means for acquiring target moving direction information of the boat, a target moving speed information acquiring means for acquiring target moving speed information of the boat, and a target bow direction information acquiring means for acquiring target bow direction information of the boat. The controller can also include a moving direction information detecting means for detecting current moving direction information of the boat, a moving speed information detecting means for detecting current moving speed information of the boat, a bow direction information detecting means for detecting current bow direction information of the boat, and a geometric information acquiring means for acquiring geometric information of the boat and the propulsion units. The controller can include a target control value calculating means for calculating target propulsion forces and target steering angles for the propulsion units based on the target moving direction information, the target moving speed information, the target bow direction information, the moving direction information, the moving speed information, the bow direction information, and the geometric information, so that the boat moves at the target moving speed in the target moving direction with the bow directed in the target bow direction. The controller can also include a propulsion unit control means for controlling the propulsion units based on the target propulsion force and the target steering angle calculated by the target control value calculating means.

In accordance with another embodiment, a program is provided for controlling a propulsion unit controller for controlling multiple propulsion units on a boat, at least one propulsion unit provided at the port stern and at least one unit provided at the starboard stern of the boat. The program can be configured such that a computer implements a process using a target moving direction information acquiring means for acquiring target moving direction information of the boat, a target moving speed information acquiring means for acquiring target moving speed information of the boat, and a target bow direction information acquiring means for acquiring target bow direction information of the boat. The program can also be configured to direct a computer to use a moving direction information detecting means for detecting current moving direction information of the boat, a moving speed information detecting means for detecting current moving speed information of the boat, a bow direction information detecting means for detecting current bow direction information of the boat, and a geometric information acquiring means for acquiring geometric information of the boat and the propulsion units. The program can also be configured to direct a computer to use a target control value calculating means for calculating target propulsion forces and target steering angles for the propulsion units so that the boat moves at the target moving speed in the target moving direction based on the target moving direction information, the target moving speed information, the target bow direction information, the moving direction information, the moving speed information, the bow direction information, and the geometric information, with the bow directed in the target bow direction. The program can also be configured to direct a computer to use a propulsion unit control means for controlling the propulsion units based on the target propulsion forces and the target steering angles calculated by the target control value calculating means.

In accordance with yet another embodiment, a method is provided for controlling a propulsion unit controller for controlling propulsion units, at least one unit provided at the port stern and at least one unit provided at the starboard stern of a boat. The method can comprise the steps of acquiring target moving direction information of the boat, acquiring target moving speed information of the boat, and acquiring target bow direction information of the boat. The method can also include detecting current moving direction information of the boat, detecting current moving speed information of the boat, detecting current bow direction information of the boat, and acquiring geometric information of the boat and the propulsion units. The method can also include calculating target control values, the target propulsion forces and the target steering angles, of the propulsion units so that the boat moves at the target moving speed in the target moving direction based on the target moving direction information, the target moving speed information, the target bow direction information, the moving direction information, the moving speed information, the bow direction information, and the geometric information, with the bow directed in the target bow direction, and controlling the propulsion units based on the target propulsion forces and the target steering angles calculated in the step of calculating the target control values.

In accordance with a further embodiment, a controller is provided for a propulsion unit on a boat for controlling propulsion units, at least one provided at the port stern and at least one provided at the starboard stern of the boat. The controller can comprise a target moving direction information acquiring device configured to acquiring target moving direction information of the boat, a target moving speed information acquiring device configured to acquire target moving speed information of the boat, and a target bow direction information acquiring device configured to acquire target bow direction information of the boat. The controller can also include a moving direction information detecting device configured to detect current moving direction information of the boat, a moving speed information detecting device configured to detect current moving speed information of the boat, a bow direction information detecting device configured to detect current bow direction information of the boat, and a geometric information acquiring device configured to acquire geometric information of the boat and the propulsion units. The controller can also include a target control value calculating device configured to calculate target propulsion forces and target steering angles for the propulsion units based on the target moving direction information, the target moving speed information, the target bow direction information, the moving direction information, the moving speed information, the bow direction information, and the geometric information, so that the boat moves at the target moving speed in the target moving direction with the bow directed in the target bow direction, and a propulsion unit control device configured to control the propulsion units based on the target propulsion force and the target steering angle calculated by the target control value calculating device.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures:

FIG. 1(*b*) shows an example of translation motion of the outboard motor-propelled boat.

FIG. 5(*b*) shows exemplary motion patterns of the outboard motor-propelled boat 100 corresponding to the preset values of moving directions in the respective quadrants shown in FIG. 5(*a*).

DETAILED DESCRIPTION OF THE PREFERRED EMBODIMENT

Figure 1:
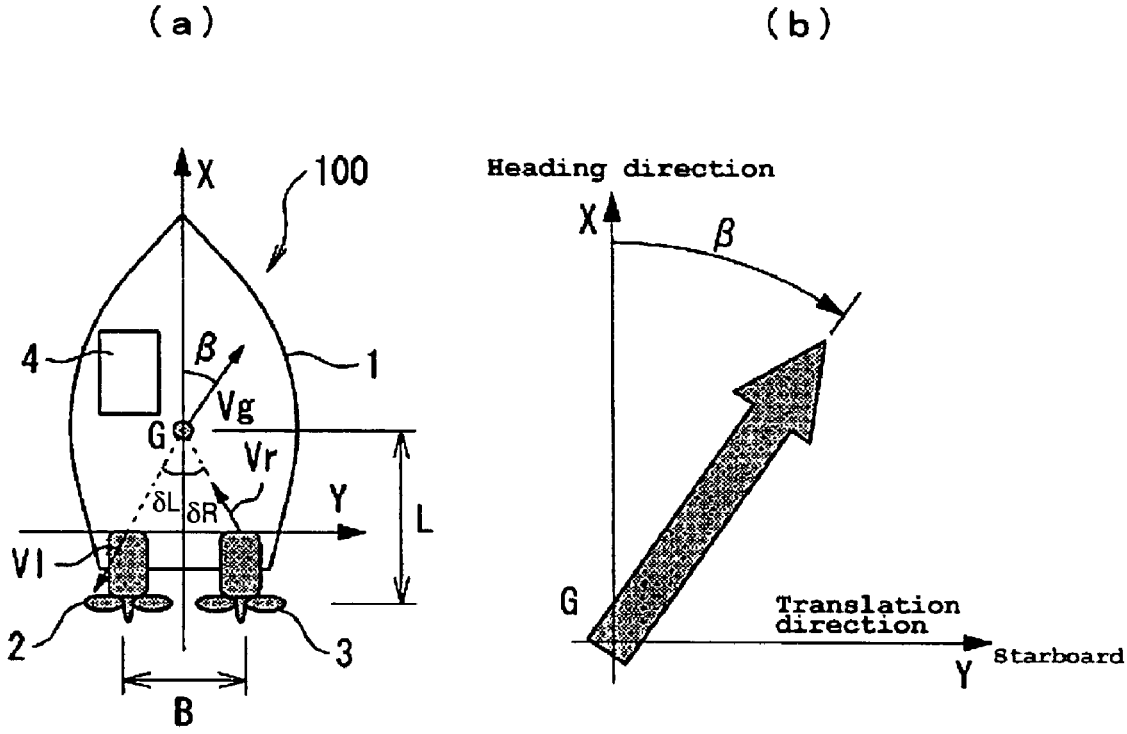
FIG. 1(*a*) shows a geometric relationship between a boat body and outboard motors on an outboard motor-propelled boat.

FIG. 1(*a*) is a schematic top plan view of a small boat 100 having a controller for operating plural outboard motors in accordance with an embodiment. The embodiments disclosed herein are described in the context of a small watercraft having multiple outboard motors because the embodiments disclosed herein have particular utility in this context. However, the embodiments and inventions herein can also be applied to other boats having other types of propulsion units as well as other types of vehicles.

As used herein, the terms "front," "rear," "left," "right," "up" and "down," correspond to the direction assumed by a driver of the boat 100.

FIG. 1(*a*) shows geometric relationships between a boat body and an outboard motor on a boat. FIG. 1(*b*) shows an example of translating motion of the boat. First, the geometric relationship between the boat body and the outboard motors is described in reference to FIG. 1.

As shown in FIG. 1(*a*), an outboard motor-propelled boat 100 is includes a boat body 1, a port outboard motor 2, a starboard outboard motor 3, and a propulsion unit controller 4. A longitudinal center line passes through the bow and stern and equally dividing the boat body 1 into two (port and starboard). A used herein, the longitudinal center line is referred to as the X-axis, and a line extended from the transom of the boat body 1 perpendicular to the X-axis is referred to as the Y-axis.

An instantaneous center of the boat body is identified as G. The distance from the point G to the outboard propeller position is identified as L. The absolute value of the center-to-center distance between the port outboard motor 2 and the starboard outboard motor 3 is identified as B. An angle between the moving direction of the instantaneous center G and the X-axis is identified as β.

A vector V1 represents the magnitude of propulsion force of the port outboard motor 2 at a start point (Y, X)=(0, B/2). A vector Vr represents the magnitude of propulsion force of the starboard outboard motor 3 at a start point (Y, X)=(0, −B/2). An angle between V1 and the X-axis is identified as δL, and an angle between Vr and the X-axis is identified as δR. Here, if the intersection of V1 and Vr is at G, then δL=−δR=tan−1 (B/2L).

That is to say, in this embodiment as shown in FIG. 1(*a*), the propulsion unit controller 4 causes the intersection of action lines of the propulsion force vector V1 of the port outboard motor 2 and the propulsion force vector Vr of the starboard outboard motor 3 to be in agreement with the instantaneous center G, and uses a resultant vector Vg thereof to calculate the propulsion force for translating the outboard motor-propelled boat 100 in the direction of the starboard angle β of the boat body 1 as shown for example in FIG. 1(*b*).

Figure 2:
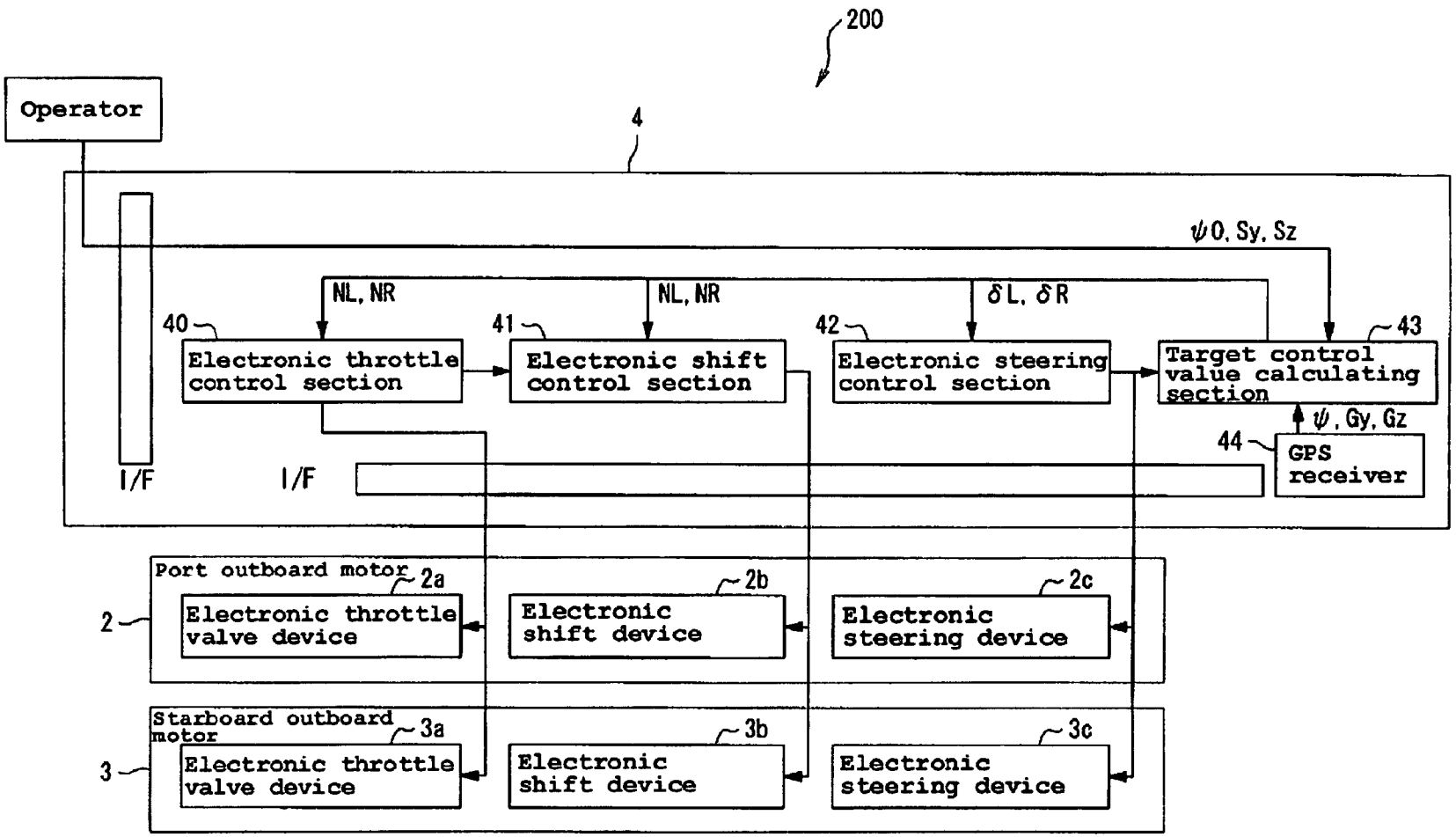
FIG. 2 is a detailed block diagram, showing a configuration of a boat control system 200 having a propulsion unit controller 4, a port outboard motor 2, and a starboard outboard motor 3 in accordance with an embodiment.
Figure 3:
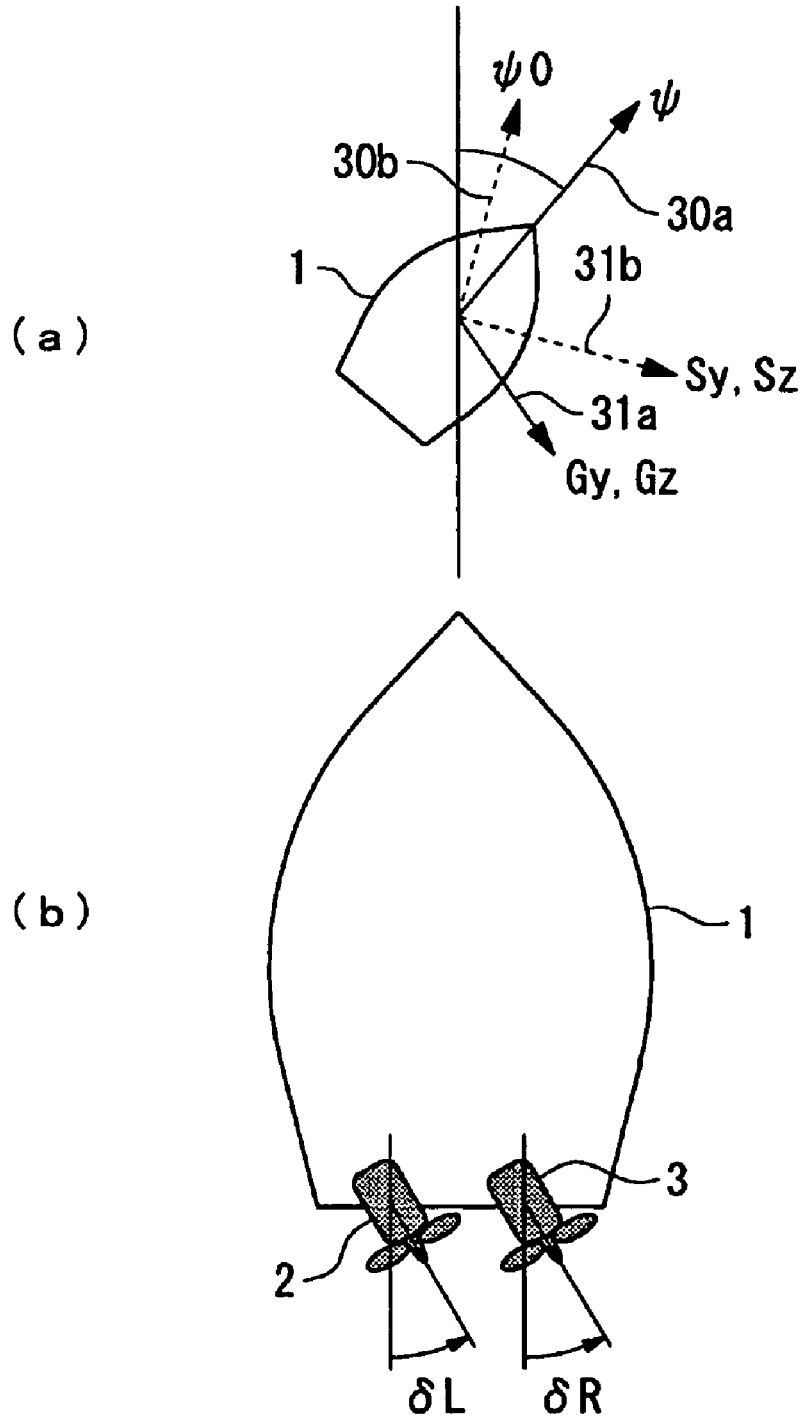
FIGS. 3(*a*) and 3(*b*) illustrate exemplary relationships between preset target values and current boat motions.
Figure 4:
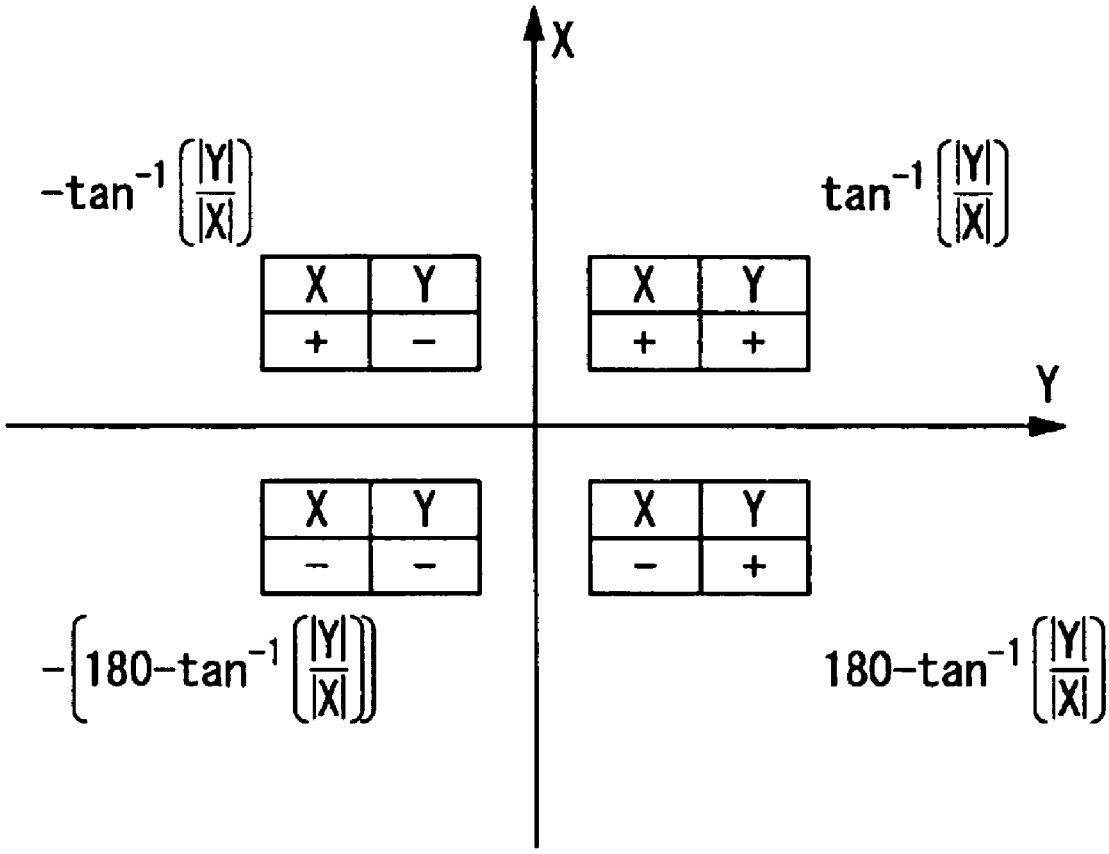
FIG. 4 shows an exemplary relationship between moving direction and steering angle of an outboard motor-propelled boat 100.
Figure 5:
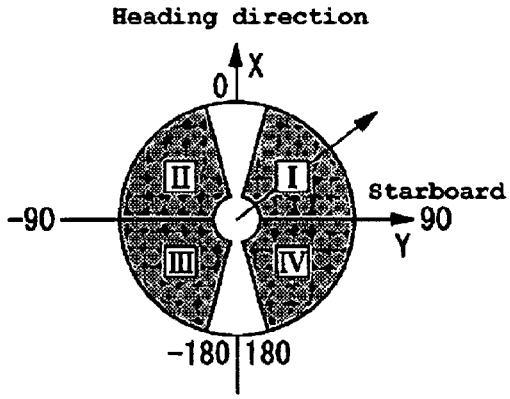
FIG. 5(*a*) shows exemplary moving directions (angle with respect to bow direction) of an outboard motor-propelled boat 100 in the first to fourth quadrants.
Figure 5:
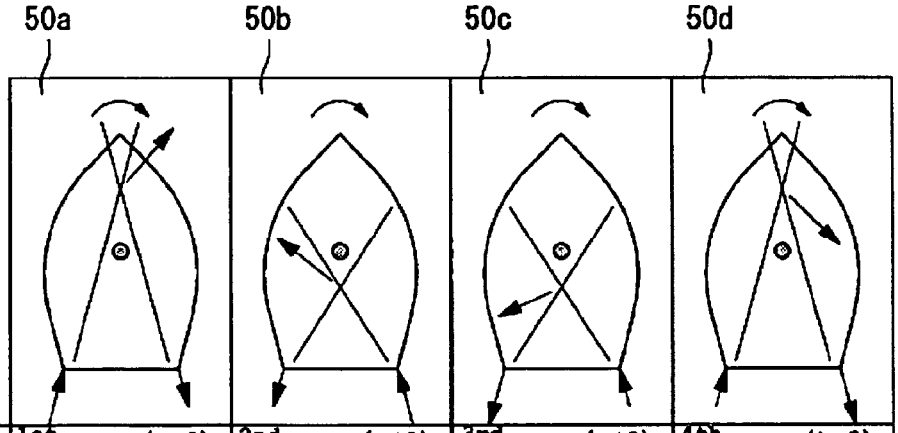

Translation control of the outboard motor-propelled boat 100 is described below with reference to FIGS. 2 to 5. FIG. 2 is a detailed block diagram of configuration of a boat control system 200 made up of the propulsion unit controller 4, the port outboard motor 2, and the starboard outboard motor 3 in accordance with an embodiment. FIG. 3 shows an exemplary relationship between preset target values and a current boat motion. FIG. 4 shows an exemplary relationship between a moving direction and a steering angle of the outboard motor-propelled boat 100. FIG. 5(*a*) shows a moving direction (angle with respect to bow direction) of the outboard motor-propelled boat 100 in the first to fourth quadrants. FIG. 5(*b*) shows exemplary motion patterns of the outboard motor-propelled boat 100 corresponding to the preset values of the moving directions in the respective quadrants shown in FIG. 5(*a*).

As shown in FIG. 2, the boat run control system 200 can includes the propulsion unit controller 4, the port outboard motor 2, and the starboard outboard motor 3. The propulsion unit controller 4 can include an electronic throttle valve control section 40, an electronic shift control section 41, an electronic steering control section 42, a target control value calculating section 43, and a GPS receiver 44.

The electronic throttle valve control section 40 can be configured to calculate electronic throttle valve openings of the port outboard motor 2 and the starboard outboard motor 3 based on the engine revolution NL of the port outboard motor 2 and the engine revolution NR of the starboard outboard motor 3 from the target control value calculating section 43. Additionally, the electronic throttle valve control section 40 can be configures to control the electronic throttle valve devices of the port outboard motor 2 and the starboard outboard motor 3 so that they are in agreement with the calculated electronic throttle valve openings.

The electronic shift control section 41 can be configured to calculate electronic shift positions of the port outboard motor 2 and the starboard outboard motor 3 based on the engine revolution NL of the port outboard motor 2 and the engine revolution NR of the starboard outboard motor 3 from the target control value calculating section 43. Additionally, the electronic shift control section 41 can be configured to control the electronic shift devices of the port outboard motor 2 and the starboard outboard motor 3 so that they are in agreement with the calculated electronic shift positions. In some embodiments, the electronic shift positions can be stored in a rule table which outputs the electronic shift positions (forward, neutral, and reverse) according to conditions, such as the sign of the engine revolution NL or Nr, and input information from other input devices.

The electronic steering control section 42 can be configured to calculate electronic steering angles for the port outboard motor 2 and the starboard outboard motor 3 from the steering angle δL of the port outboard motor 2 and the steering angle δR of the starboard outboard motor 3 from the target control value calculating section 43. Additionally, the electronic steering control section 42 can be configured to control the electronic steering devices of the port outboard motor 2 and the starboard outboard motor 3 so that they are in agreement with the calculated electronic steering angles.

With continued reference to FIGS. 2 and 3, the target control value calculating section 43 can be configured to calculate the engine revolutions NL and NR, the steering angles δL and δR of the port and starboard outboard motors 2 and 3, respectively based on: the target moving speed Sy [e.g., expressed in knots], target moving direction Sz [e.g, degrees], and target bow direction ψ0 [e.g, degrees] preset by an operator; current moving speed Gy [e.g., knots], current moving direction Gz [e.g., degrees], and current bow direction ψ [e.g., degrees] detected by the GPS receiver 44; and the above-described geometric information between the boat body 1 and the outboard motors, so that the outboard motor-propelled boat 100 moves at the target moving speed Sy in the target moving direction Sz with the bow directed to the target bow direction ψ0.

The GPS receiver 44 is an operator's receiver for receiving electric signals from satellites of the known GPS (global positioning system) which is now made up of 24 GPS satellites (4 each on 6 orbit surfaces) orbiting at an altitude of about 20,000 km around the globe, a control station for carrying out control and tracing of the GPS satellites, and the operator's receiver for carrying out positioning. Other positioning systems can also be used.

In some embodiments, the position, moving direction and moving speed, etc. of the boat 100 are determined by simultaneous detection of distances from four or more GPS satellites. The information on the moving direction and moving speed determined from the electric signals received from the GPS satellites can be input to the target control value calculating section 43. In some embodiments, the GPS receiver 44 can be provided with or connected to a direction sensor (gyro-sensor) to detect the bow direction of the boat 100. The detected bow direction information can be input to the target control value calculating section 43.

With continue reference to FIG. 2, the port outboard motor 2 can include an electronic throttle valve device 2*a* which can be configured to serve as a propulsion force regulating device, an electronic shift device 2*b* which can be configured to serve as a propulsion force direction regulating device, and an electronic steering device 2*c* which can be configured to serve as a steering angle regulating device. In some embodiments, an intake air amount to the internal combustion engine (not shown) is regulated with the electronic throttle valve device 2*a* to regulate the engine revolution, which in turn regulates the propeller revolution. In this embodiment, a variable pitch propeller can also be used, so that propelling direction (forward or reverse) is regulated by regulating the propeller pitch. This configuration can also be used for the starboard outboard motor 3.

The starboard outboard motor 3 can include: an electronic throttle valve device 3*a* which can be configured to serve as a propulsion force regulating device, an electronic shift device 3*b* which can be configured to serve as a propulsion force direction regulating device, and an electronic steering device 3*c* which can be configured to serve as a steering angle regulating device. In other words, this embodiment is made up by including the internal combustion engine. This embodiment is constituted such that intake air amount to the internal combustion engine (not shown) can be regulated with the electronic throttle valve device 3*a* to regulate the engine revolution, which in turn regulates the propeller revolution.

In this embodiment, the boat control device 200 can include: a storage medium (not shown) on which a program for controlling the various sections can be stored, a CPU for implementing or "running" the program, and a RAM for storing data that can be used to implement or run the program.

The storage medium can be any type of storage device. In some embodiments, the storage device is configured to be readable with a computer regardless of reading method, electronic, magnetic, or optical. The storage device can be a semiconductor storage medium such as a RAM or ROM, a magnetic storage medium such as an FD or HD, an optically readable storage medium such as a CD, CDV, LD, or DVD; or a magnetically storable/optically readable storage medium such as an MO.

In preparation for operation, the above-described dimensions L and B can be measured and stored in a storage medium (not shown) that is provided in the target control value calculating section 43. This has to be done only once when the attachment positions of the boat body 1, the port outboard motor 2 and the starboard outboard motor 3 are respectively determined.

Next, the operator can set the target moving speed Sy, the target moving direction Sz, and the target bow direction ψ0. The setting can be done through a dedicated input device such as a joystick or a dial, or through a keyboard (not shown). The target values set are input to the propulsion unit controller 4.

When Sy, Sz, and ψ0 are input, the propulsion unit controller 4 acquires the current moving speed Gy, current moving direction Gz, and current bow direction ψ from the GPS receiver 44. Based on these Sy, Sz, ψ0, Gy, Gz, ψ; and B and L stored in the storage medium, the controller 4 further calculates the engine revolution NL and the steering angle δL of the port outboard motor 2, and the engine revolution NR and the steering angle δR of the starboard outboard motor 3 for moving the boat 100 in the state in agreement with the above target values set by the operator. The calculated NL and NR are respectively input to the electronic throttle valve control section 40 and to the electronic shift control section 41, while the calculated δL and δR are input to the electronic steering control section 42.

The relationship among Sy, Sz, ψ0, Gy, Gz, ψ is schematically shown in FIG. 3(*a*). In FIG. 3(*a*), the solid line arrow 30*a* indicates the current bow direction ψ, while the broken line arrow 30*b* the target bow direction ψ0. Also in FIG. 3(*a*), the solid line arrow 31*a* indicates the current moving speed Gy and moving direction Gz, and the broken line arrow 31*b* the target speed Sy and target moving direction Sz. The lengths of the solid line arrows 31*a* and 31*b* represent the magnitudes of speed.

The propulsion force controller 4 can be configured to determine the propulsion forces (engine revolutions NL and NR in this embodiment), propelling directions (sign of + or −), steering angles (δL and δR), and steering directions (sign of + or −) of the port outboard motor 2 and the starboard outboard motor 3 in order to bring the current bow direction ψ of the boat 100 to the target bow direction ψ0, bring the current moving direction 100 to the target moving direction Sz, and bring the current moving speed Gy to the target moving speed Sy.

In this manner, the target electronic throttle valve opening is calculated in the electronic throttle valve control section 40, the target electronic shift position is calculated in the electronic shift control section 41, and the target electronic steering angle is calculated in the electronic steering control section 42. When the target electronic throttle valve opening, the target electronic shift position, and the target electronic steering angle are calculated as described above, the electronic throttle valve devices 2*a* and 3*a* are controlled to be in the agreement with the calculated target electronic throttle valve opening, the electronic shift device 2*b* and 3*b* are controlled to be in agreement with the calculated target electronic shift positions, and the electronic steering device 2*c* and 3*c* are controlled to be in agreement with the calculated target electronic steering angles. An exemplary algorithm for setting the target engine revolution is described below:

When the steering angle of the outboard motor is a0 [degrees], the X-axis direction component X and the Y-axis direction component Y of the boat 100 can be expressed with the equations (1) and (2) below:

$$X=NL*\cos a0+NR*\cos a0 \quad (1)$$

$$Y=NL*\sin a0-NR*\sin a0 \quad (2)$$

In this embodiment, in order to make the propulsion force direction in agreement with the instantaneous center G, a relationship is determined to be a0=−δL0=δR0. Assuming the angle between the X-axis and the motion direction of the boat 100 in translation motion to be β [degrees], tan β can be expressed as follows using the above equations (1) and (2):

$$\tan\beta=Y/X=(NL-NR)\sin a0/(NL+NR)\cos a0=\{(NL-NR)/(NL+NR)\}*\tan a0 \quad (3)$$

Because tan a0=B/2L from the above-described geometric relationship between the boat body 1 and the outboard motors, the equation (3) above can be expressed with the equation (4) below:

$$\tan\beta=\{(NL-NR)/(NL+NR)\}*B/2L \quad (4)$$

The X-direction component x and the Y-direction component y of the propulsion force sufficient for moving the boat 100 corresponding to the target values are expressed with the following equations (5) and (6) below using the target values Sy and Sz, and Gy and Gz received from the GPS receiver 44:

$$x=Sy^{*}\cos Sz-Gy^{*}\cos Gz \quad (5)$$

$$y=Sy^{*}\sin Sz-Gy^{*}\sin Gz \quad (6)$$

From the above equations (5) and (6), the relationship between the target values (Sy, Sz) and the motions (Gy, Gz) of the boat 100 in this embodiment are converted into joystick indication values (Jy, Jz) using the equations (7) and (8) below:

$$Jy=\{(X2+Y2)\}^{1/2} \quad (7)$$

$$Jz=\tan-1(y/x)-\psi \quad (8)$$

Here, assuming that the relationship NR=NL holds, the above equation (4) is expressed as the equation (9) below:

$$\tan\beta=\tan Jz=\{(1-k)/(1+k)\}^{*}\tan a0=\{(1-k)/(1+k)\}^{*}B/2L \quad (9)$$

Assuming that Jz=β and using the above equation (9), k is expressed with the equation (10) below:

$$k=(B/2L-\tan Jz)/(B/2L+\tan Jz) \quad (10)$$

In other words, determination of the engine revolution NL of the port outboard motor 2 results in the determination of the engine revolution NR of the starboard outboard motor 3 according to the equation (10).

The angle β [degrees] between the X-axis and the moving direction of the boat 100 in translation is shown in FIG. 5. Assuming the intersection of a circle centered on the instantaneous center of the boat 100 with the positive axis of the bow direction to be a start point 0 degree, and the intersection of the circle with the negative axis of the stern direction to be end points (180 degrees and −180 degrees), β=tan−1 {|Y|/|X|} in the range of the moving direction of the boat 100 between 0 and 90 degrees (1st quadrant), β=−tan−1{|Y|/|X|} in the range between 0 and −90 degrees (2nd quadrant), β=−{180−tan−1 {|Y|/|X|}} in the range between −90 and −180 degrees (3rd quadrant), and β=180−tan−1 {|Y|/|X|} in the range between 90 and 180 degrees (4th quadrant). In this embodiment, the moving direction of the boat 100 is indicated counterclockwise, in the range of 0 to −180 degrees, for the port direction. On the other hand, the starboard direction is indicated clockwise, in the range of 0 to 180 degrees.

When the angle of moving direction of the boat 100 is divided into 1st to 4th quadrants (I to IV) as shown in FIG. 5(*a*), motion patterns of the boat 100 in respective quadrants are as shown in FIG. 5(*b*). In other words, the motion pattern of the boat 100 may be roughly divided into eight as shown in FIG. 5(*b*), two patterns (right turn and left turn) for each quadrant, according to the sign of the Jz value and the sign of the value (ψ-ψ0). Here, the sign of Jz with respect to the Y-axis in FIG. 5(*a*) is negative when the joystick is operated to port side and positive when operated starboard side.

As for the example shown in FIG. 3, because the joystick is operated to the starboard side so as to move the boat 100 in the starboard direction, the sign of Jz is positive. Because the boat 100 is moved in the direction of the 1st quadrant (I in FIG. 5(*a*)), the motion pattern of the boat 100 is 50*a* in FIG. 5(*a*). Further, because the sign of (ψ−ψ0) is negative, the pattern is that on the right of 50*a*. In other words, because the steering angle δL of the port outboard motor 2 is negative, the angle of the propeller currently directed obliquely left rearward is to be increased. On the other hand, because the steering angle δR of the starboard outboard motor 3 is positive, the angle of the propeller currently directed obliquely right rearward is to be increased.

Because the engine revolution NL of the port outboard motor 2 is "great" and the propelling direction is positive and the engine revolution NR of the starboard outboard motor 3 is "small" and the propelling direction is negative, the port and starboard outboard motors are in the state of laterally swung apart from each other. In that state, the port outboard motor 2 produces a great propulsion force to propel the boat 100 forward. On the other hand, the starboard outboard motor. 3 produces a small propulsion force to propel the boat 100 reverse. As a result, the boat 100 moves in the target moving direction of the 1st quadrant while the bow is being turned toward the left.

In this embodiment, the specified engine revolution and steering angle are calculated by the equations (11) to (13) below for the 1st and 4th quadrants out of the 1st to 4th quadrants, and with equations (14) to (16) for the 2nd and 3rd quadrants:

$$NL=Jy\times FR0900\times\{1-(1-(Jy/PYJMAX))PR09MM\}PR09NN \quad (11)$$

$$\delta L=-\delta R=-(C1\times(\psi-\psi0)+a0) \quad (12)$$

$$NR=k^{*}NL \quad (13)$$

$$NR=Jy\times FR0900\times\{1-(1-(Jy/PYJMAX))PR09MM\}PR09NN \quad (14)$$

$$\delta L=-\delta R=(C1\times(\psi-\psi0)+a0) \quad (15)$$

$$NL=k^{*}NR \quad (16)$$

where, PJYMAX is the maximum tilt angle of the joystick, FR0900 is a parameter determined according to outboard motor engine characteristic, C1 is a factor determined from the boat body 1 and outboard motor engine characteristic, PR09MM and PR09NN are parameters for determining the relationship between Jy and engine revolution.

Figure 6:
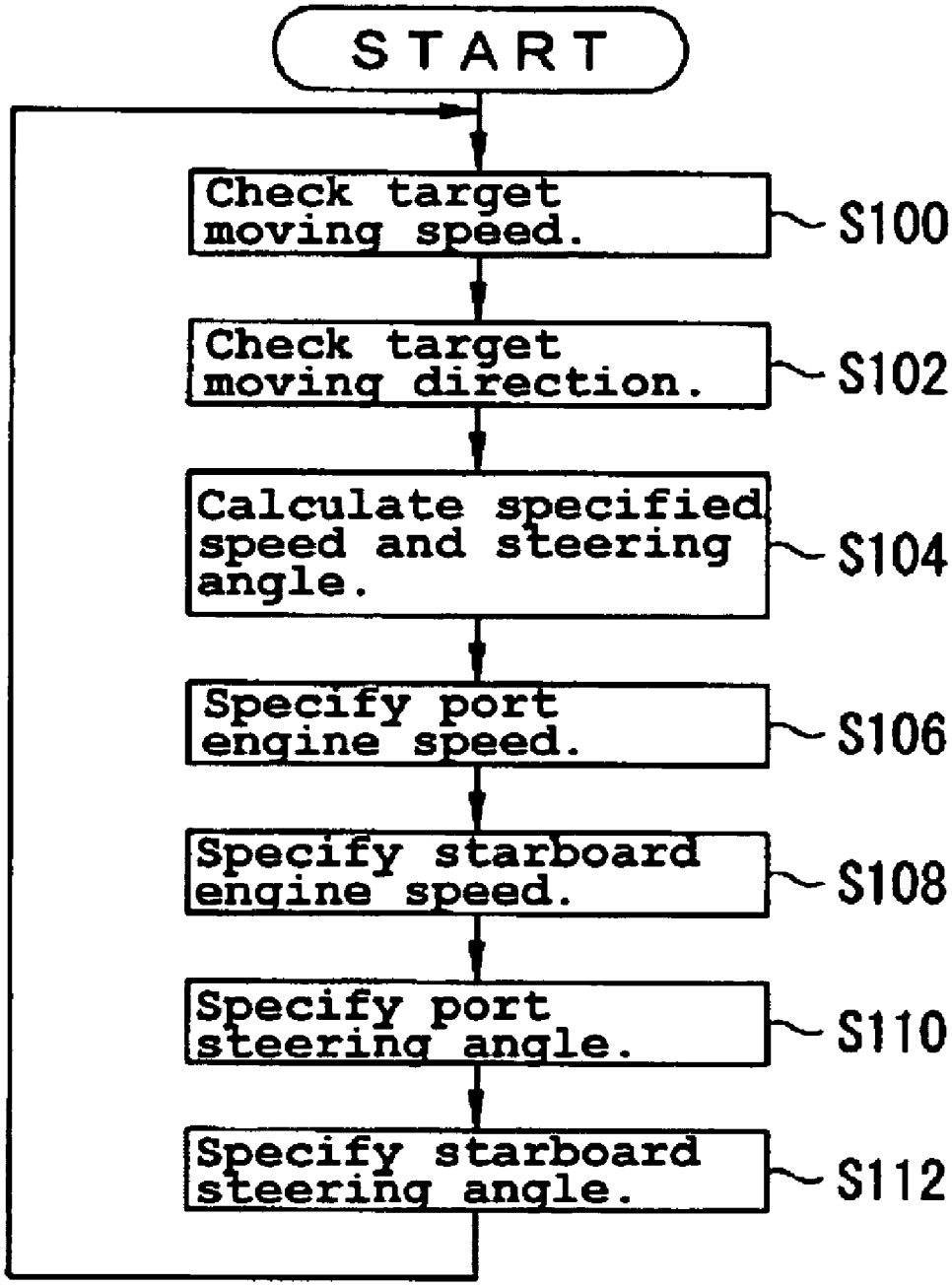
FIG. 6 is a flowchart illustrating a control routine that can be used with the propulsion unit controller 4.

Next, the process flow of the action of the propulsion unit controller 4 is described in reference to FIG. 6, a flowchart of the action of the propulsion unit controller 4. As shown in FIG. 6, first the process goes to the step S100 in which the target control value calculating section 43 checks the target moving speed Sy set by the operator and the process moves on to the step S102.

In the step S102, the target control value calculating section 43 checks the target moving direction Sz set by the operator and the process moves on to the step S104.

In the step S104, the specified engine revolution and steering angle of the port outboard motor 2 and starboard outboard motor 3 are calculated and the process moves on to the step S106. Here, the target control value calculating section 43 inputs the calculation results, the engine revolutions NL and NR into the electronic throttle valve control section 40 and the electronic shift control section 41, and inputs the steering angles δL and δR into the electronic steering control section 42.

In the step S106, the electronic throttle valve control section 40 sets the electronic throttle valve opening for the electronic throttle valve device 2*a* of the port outboard motor 2, and the electronic shift control section 41 sets the shift position for the electronic shift device 2*b*. Then the process moves on to the step S108.

In the step 108, the electronic throttle valve control section 40 sets the electronic throttle valve opening for the electronic throttle valve device 3*a* of the starboard outboard motor 3, and the electronic shift control section 41 sets the shift position for the electronic shift device 3*b*. Then the process moves on to the step S110.

In the step S110, the electronic steering control section 42 sets the steering angle δL for the electronic steering device 2*c* of the port outboard motor 2. Then, the process moves on to the step S112.

In the step S112, the electronic steering control section 42 sets the steering angle δR for the electronic steering device 3c of the starboard outboard motor 3. Then, the process moves on to the step S100.

The above process in the steps S100 to S112 is repeated at a specified period (for example at a period of 0.1 seconds). In this way the feedback control is performed so that, in time, the boat 100 moves according to the preset target values.

Figure 7:
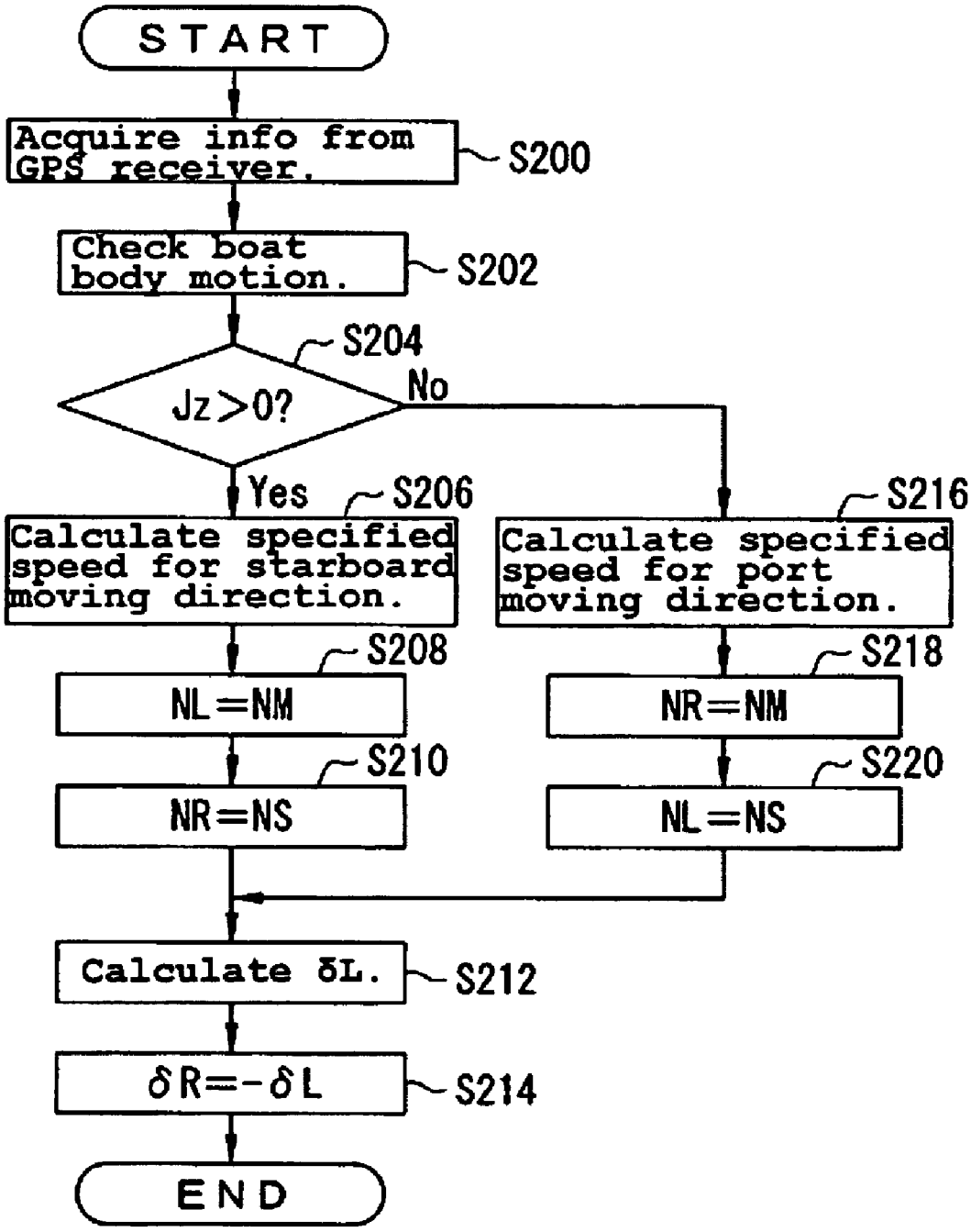
FIG. 7 is a flowchart illustrating a control routine that can be used to calculate a specified engine speed and steering angle.

Next, the process flow of calculating the specified engine revolution and the steering angle in the above-mentioned step S104 with the target control value calculating section 43 of the propulsion unit controller 4 is described in reference to FIG. 7 which shows a flowchart of the process of calculating the specified engine revolution and the steering angle.

As shown in FIG. 7, first the process moves on to the step S200 in which information on the current moving direction, current moving speed, and current bow direction of the boat 100 is acquired from the GPS receiver 44, and then the process moves on to the step S202.

In the step S202, motion of the boat 100 is checked with the information acquired in the step S100, and then the process moves on to the step S204.

In the step S204, a determination is made whether or not the specified value Jz for the joystick toward the target moving direction is greater than zero. If determined to be greater (Yes), the process moves on to the step S206, and if not (No), to the step S216. Here, the determination of Jz in the step S204 is made relative to the specified value in the Y-axis direction shown in FIG. 5(*a*). In this embodiment, the sign of Jz is positive when the boat 100 is moved toward the starboard direction, and negative when it is moved toward the port direction.

In case the process moves on to the step S206, the specified engine revolution is calculated by the moving direction of the boat 100 assumed to be port direction, and the process moves on to the step S208.

In the step S208, the engine revolution NL of the port outboard motor 2 is set to be a main revolution NM, and the process moves on to the step S210. The main revolution NM parameter is described below in greater detail.

In the step S210, the engine revolution NR of the starboard outboard motor 3 is set to be a sub revolution NS, and the process moves on to the step S212. The sub revolution NS is also described below in greater detail.

In the step S212, the steering angle δL of the port outboard motor 2 is calculated, and the process moves on to the step S214.

In the step S214, the steering angle 6R of the starboard outboard motor 3 from the geometric relationship between the boat body I and the outboard motors to finish the process. For example, the steering angle δR can be set to the negative of the steering angle δL.

In case Jz is not greater than zero in the step S204 and the process moves on to the step S216, the specified engine revolution is calculated by the moving direction of the boat 100 assumed to be starboard direction, and the process moves on to the step S218.

In the step S218, the engine revolution NR of the starboard outboard motor 3 is set to be a main revolution NM, and the process moves on to the step S220.

In the step S220, the engine revolution NL of the port outboard motor 2 is set to be a sub revolution NS, and the process moves on to the step S212.

Figure 8:
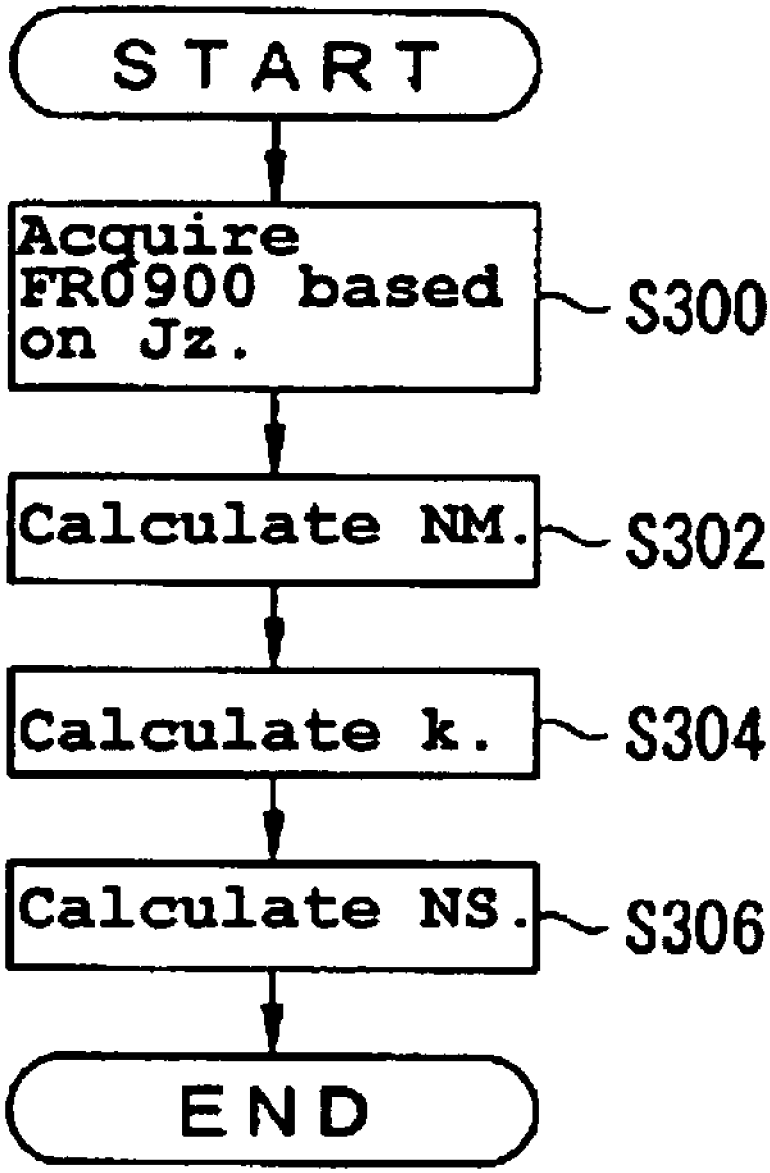
FIG. 8 is a flowchart illustrating a control routine that can be used to calculate a specified engine speed.

The process of calculating the specified engine revolution in the above steps S206 and S216 with the target control value calculating section 43 of the propulsion unit controller 4 is described in reference to FIG. 8, a flowchart of the process of calculating the specified engine revolution.

As shown in FIG. 8, the process can begin with a step S300 to acquire a parameter FR0900 for calculating the main specified revolution NM of the engine corresponding to the specified value Jz for the joystick. The process can then move on to the step S302.

In the step S302, the acquisition of the parameter FR0900 is made by inputting Jz and reading from a data table a parameter value corresponding to the input Jz. This data table can be stored in a storage medium (not shown). In some embodiments, values can be set at 15 degree intervals on the moving direction range of 0 to 180 degrees (the same for both port and starboard) of the boat 100. However, other increments can also be used.

Figure 9:
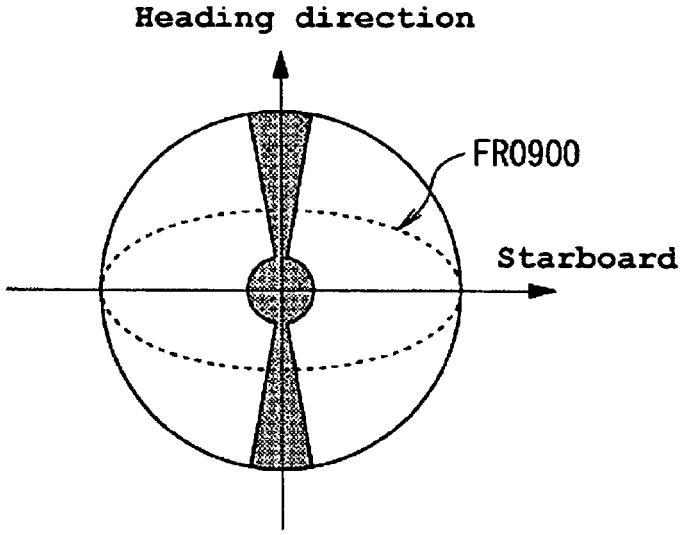
FIG. 9 illustrates a characteristic of the parameter identified as FR0900.

The parameter FR0900 can be a value determined according to the engine characteristic of the outboard motor, and is, as shown in FIG. 9, set so that the moving speed of the boat 100 is made constant with this parameter relative to respective tilt directions of the joystick. FIG. 9 represents the nature of the parameter FR0900. In other words, the parameter is set so that the engine revolution becomes higher in proportion to the increase in the number of factors causing the boat 100 to move laterally. In this case, the parameter is greatest when moving at right angles to longitudinal direction. On the other hand, it is smallest when moving forward or reverse. Therefore, the parameter FR0900 is elliptical for Jz as shown with broken line in FIG. 9.

In the step S302, the main revolution NM is calculated using the above equation (11) or (14), and the process moves on to the step S304. In the step 304, the NM is obtained using the equation (17) below:

$$NM=Jy\times FR0900\times\{1-(1-(Jy/PYJMAX))^{PR09MM}\}^{PR09NN} \quad (17)$$

In this embodiment, the maximum engine revolution PNEMAX is used as Jy of the above equation (17). The parameters PR09MM and PR09NN in the equations (11) and (14), as described above, are values that determine the relationship between the specified value Jy for the joystick and the engine revolution. According to their values, the relationship between Jy and engine revolution may be made a line of secondary degree or a straight line. Thus, it is possible, for example, to make the engine speed the same when the joystick is tilted by ⅔ of full tilt or tilted to full tilt.

The above revolution NM is the engine revolution of one of the port and starboard outboard motors chosen as a reference. In this embodiment, the port outboard motor 2 is chosen as the reference when the range of moving direction of the boat 100 falls within the 1st and 4th quadrants. On the other hand, the port outboard motor 3 is chosen as the reference when the range of moving direction of the boat 100 falls within the 2nd and 3rd quadrants.

In the step S304, k is calculated using the above equation (10) and the values B and L stored in a storage medium (not shown) and the process moves on to the step S306. In the step S306, the sub revolution NS can be calculated by the above equations (13) or (16) to finish the process. Here, NS is obtained from the equation (18) below:

$$NS=k*NM \quad (18)$$

The above sub revolution NS is the engine revolution of the outboard motor that is not chosen as the reference.

Figure 10:
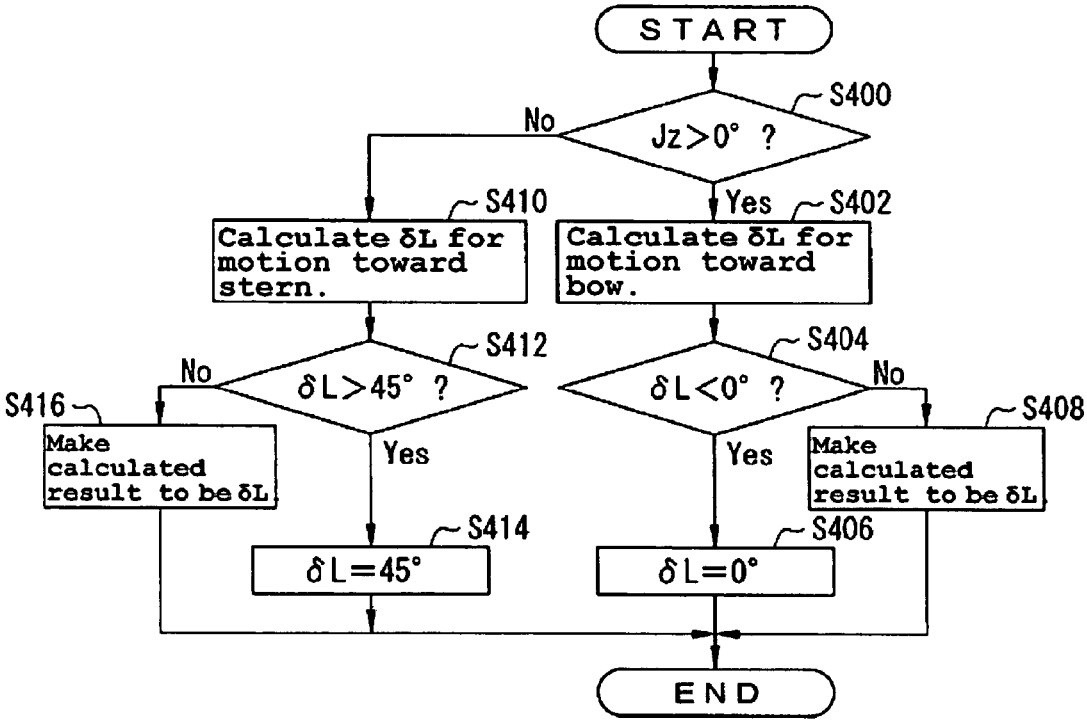
FIG. 10 is a flowchart, illustrating a control routine that can be used to calculate the steering angle δL of a port outboard motor 2.

The process of calculating the steering angle δL of the port outboard motor 2 in the above steps S212 with the target control value calculating section 43 of the propulsion unit controller 4 is described in reference to FIG. 10, which includes a flowchart of the process of calculating the steering angle δL of the port outboard motor 2.

As shown in FIG. 10, the process can begin with the step S400 to determine whether or not Jz is greater than zero. If Jz is greater than zero (Yes), then the process moves on to the step S402. Otherwise (No), the process moves on to the step S410.

The determination for Jz in the step S400 can be made for the value specified on the X-axis shown in FIG. 5(*a*). In this embodiment, the sign of Jz is positive when the boat 100 is moved forward (between 0 and 90 degrees or between 0 and −90 degrees), and negative when moved reverse.

When the process moves on to the step S402, the moving direction of the boat 100 is determined to be toward the bow direction and the steering angle δL of the port outboard motor 2 is calculated. Then the process moves on to the step S404.

In the step S404, it is determined whether or not δL calculated in the step S402 is less than zero. If it is determined that δL is less than zero (Yes), the process moves on to the step 406. Otherwise (No), the process moves on to the step S408.

In case the process moves on to the step S406, δL is set to zero degree to finish the process. On the other hand, in case of moving on to the step S408, the calculated result of the step S402 is directly set to be δL to finish the process.

In case Jz is not smaller than zero in the step S400 and the process moves on to the step S410, the boat 100 is determined to be moving in the stern direction and δL of the port outboard motor 2 is calculated using the above equation (15), and the process moves on to the step S412.

In the step S412, it is determined whether or not δL calculated in the step S410 is greater than 45 degrees. If determined that δL is greater than 45 degrees (Yes), the process moves on to the step S414, otherwise (No) to the step S416. In case of moving on to the step S414, δL can be set to be 45 degrees to finish the process.

On the other hand, in case of moving onto the step S416, the result calculated in the step S410 is used directly δL to finish the process.

Figures 11, 12:
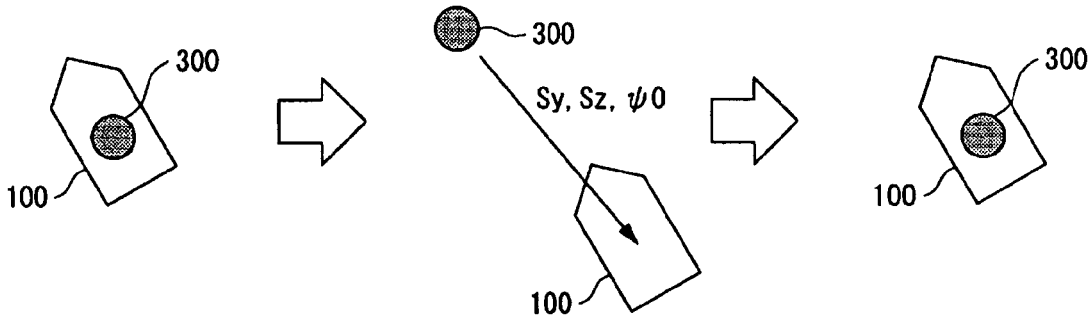
FIG. 11 shows an exemplary motion of the boat 100 in troll fishing.
FIG. 12 is an exemplary data table corresponding values of the parameter FR0900 to values of the corresponding parameter Jz.

Operations of the boat controller 200, when the boat 100 is used in troll fishing, are described in reference to FIGS. 11 and 12. FIG. 11 shows exemplary motions of the boat 100 during troll fishing. FIG. 12 is an exemplary data table of the parameter FR0900 corresponding the Jz.

As shown in FIG. 11, the operator can operate the boat 100 and determine a point 300 to be a reference or starting point. Then the operator sets the target bow direction ψ0=0 degree in consideration of tidal flow, wind direction, and the direction in which the point 300 is located. Then, the operator sets the moving speed (target moving speed Sy) and the moving direction (target moving direction Sz) for allowing the boat 100 to drift from the point 300.

An example case is described below in which the boat 100 is moved in the direction of 150 degrees from the current bow direction as the reference direction ψ0=0 degree at a speed of 5 knots.

The propulsion unit controller 4 first checks the preset target moving speed Sy=5 knots (step S100), followed by checking the target moving direction Sz=150 degrees (step S102). Then, specified revolution and the steering angle of the port outboard motor 2 and the starboard outboard motor 3 are calculated (step S104).

To calculate the specified revolution, first the moving speed Gy=1 knot, the moving direction Gz=0 degree, and the bow direction v=−30 degrees are acquired from the GPS receiver 44 (step S200). From the acquired Gy, Gz, and y, current motion of the boat is checked (step S202). Using the acquired values and the above equations (5) and (6), x=−5.33 and y=3.0 are obtained. Using these results and the above equations (7) and (8), Jy=6.12 and Jz=1 are obtained. Then whether or not the value of Jz is greater than zero is determined (step S204). In this case, because it is greater than zero, the moving direction is assumed to be port (4th quadrant) to calculate the specified revolution (step S206). Here, because Jz=1, the port outboard motor 2 is chosen as the reference, and the parameter PR0900 corresponding to Jz=0 to 15 is read from the data table shown in FIG. 12 (step S300).

Using the read PR0900 and the above equation (17), the main revolution NM, the engine revolution NL of the port outboard motor 2, is calculated (step S302). Calculation by assuming for example PR0900=5, PR09MM=PR09NN=1, PJYMAX=75 degrees, PNEMAX=3000 rpm results in NM=1000 rpm.

Next, using the above equation (10) and the values B and L stored in a storage medium (not shown), k is calculated (step S304). Assuming for example, but without limitation, B=1.5 m, L=4.0 m, and Jz=1, the value of k would be =0.829. Using the calculated k, a sub revolution NS is calculated (step S306). Calculation using the above calculated results yields NS=829 rpm. With the specified revolution obtained, the main revolution NM is set as the engine revolution NL of the port outboard motor 2 (step S208). The sub revolution NS is set as the engine revolution NR of the starboard outboard motor 3.

Next, the steering angle δL is calculated using the above equation (15) (step S212). To calculate δL, first a determination is made from the moving direction of the boat 100 whether or not Jz is greater than zero (step S400). Here, because the boat 100 is moved in the reverse direction, Jz is smaller than zero, and δL is calculated assuming that the boat is moving in the stern direction (step S410). For example, calculation assuming C1=1; a0=10.62 degrees, and using the above equation (15) results in δL=−10.62 degrees. A determination is made whether or not the calculated result δL is greater than 45 degrees (step S412). Because it is smaller in the above example calculation, the calculated result is directly used for setting δL (step S416). Because δL=−δR, this relationship is used for calculation resulting in δR=10.62 degrees (step S214).

When the engine revolutions NL and NR, and steering angles δL and δR, respectively of the port and starboard outboard motors 2 and 3 are calculated as described above, the left engine revolution NL is specified to the port outboard motor 2 (step S106), the right engine revolution NR is specified to the starboard outboard motor 3, the left steering angle δL is specified to the port outboard motor 2, and the right steering angle δR is specified to the starboard outboard motor 3, to control the port and starboard outboard motors so as to move the boat 100 in the target moving direction Sz at the target moving speed Sy with the boat directed in the target bow direction ψ.

The boat, after a travel along a specified distance, returns to the point 300, where if new target values are not set then the port and starboard outboard motors 2 and 3 are controlled according to the same target values as described above to move the boat 100 in the target moving direction Sz at the target moving speed Sy with the boat directed in the target bow direction ψ.

As described above, the boat controller 200 can control the port and standard motors 2 and 3, based on: the target moving speed Sy, the target moving direction Sz, and the target bow direction ψ0 preset by the operator; and the current moving speed Gy, the current moving direction Gz, and the current bow direction ψ of the boat 100 detected by the GPS receiver 44; utilizing the geometric relationship between the boat body 1 of the boat 100 and the outboard motors, calculating the engine revolutions NL and NR of the port starboard outboard motors 2 and 3, the steering angles δL and δR, and steering directions of the port and starboard outboard motors 2 and 3, so as to move the boat 100 in the target moving direction Sz at the target moving speed Sy with the boat directed in the target bow direction ψ.

In the disclosure set forth above, the process of setting the target moving direction Sz, target moving speed Sy, and target bow direction v used for the dedicated input device such as a joystick, dial, or keyboard can correspond to a target moving direction information acquiring means, a target moving speed information acquiring means, and a target bow direction information acquiring means, respectively.

Also, the above-described process of detecting the current moving speed Gy, moving direction Gz, and bow direction ψ of the present time can correspond to a moving direction information detecting means, a moving speed information detecting means, and a bow direction information detecting means.

Further, the above-described target control value calculating section 43 can correspond to a target control value calculating means. In the above embodiments, the electronic throttle control section 40, the electronic shift control section 41, and the electronic steering control section 42 can correspond to a propulsion unit controlling means.

Although the illustrated boat 100 provided with two outboard motors, the port and starboard outboard motors 2 and 3, the number of outboard motors is not limited to two but may be any number such as four or six. In these embodiments, it is preferable that the outboard motors are equally divided right and left.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A controller for a propulsion unit on a boat for controlling propulsion units, at least one unit provided at the port stern and at least one unit provided at the starboard stern of the boat, the controller comprising a target moving direction information acquiring means for acquiring target moving direction information of the boat, a target moving speed information acquiring means for acquiring target moving speed information of the boat, a target bow direction information acquiring means for acquiring target bow direction information of the boat wherein the target bow direction information can correspond to a direction that is different from a direction to which the target moving direction information corresponds, a moving direction information detecting means for detecting current moving direction information of the boat, a moving speed information detecting means for detecting current moving speed information of the boat, a bow direction information detecting means for detecting current bow direction information of the boat, a geometric information acquiring means for acquiring geometric information of the boat and the propulsion units, a target control value calculating means for calculating target propulsion forces and target steering angles for the propulsion units based on the target moving direction information, the target moving speed information, the target bow direction information which corresponds to a direction that is different than a direction to which the target moving direction information corresponds, the moving direction information, the moving speed information, the bow direction information, and the geometric information, so that the boat moves at the target moving speed in the target moving direction with the bow directed in the target bow direction, and a propulsion unit control means for controlling the propulsion units based on the target propulsion force and the target steering angle calculated by the target control value calculating means.

2. The controller of claim 1, wherein the geometric information includes at least one of a distance between the boat stern and the instantaneous center of the boat; distances between the center line and the respective propulsion units at the port and starboard; and numerical values related to the distances.

3. The controller of claim 1, wherein the propulsion unit is provided with an internal combustion engine, the propulsion unit control means including an intake air amount control section having a throttle valve being configured to control the intake air amount of the internal combustion engine by controlling the opening of the throttle valve, the controller further comprising a target engine revolution calculating means for calculating target engine revolutions of the port and starboard propulsion units respectively based on the target propulsion forces calculated by the target control value calculating means, and a target opening calculating means for calculating the target openings of the throttle valves of the port and starboard propulsion units respectively based on the target engine revolutions calculated by the target engine revolution calculating means, wherein the propulsion force control means controls the propulsion forces of the propulsion units by controlling the intake air amounts of the internal combustion engines by means of the intake air amount control section based on the target openings calculated by the target opening calculating means.

4. The controller of claim 2, wherein the propulsion unit is provided with an internal combustion engine, the propulsion unit control means including an intake air amount control section having a throttle valve being configured to control the intake air amount of the internal combustion engine by controlling the opening of the throttle valve, the controller further comprising a target engine revolution calculating means for calculating target engine revolutions of the port and starboard propulsion units respectively based on the target propulsion forces calculated by the target control value calculating means, and a target opening calculating means for calculating the target openings of the throttle valves of the port and starboard propulsion units respectively based on the target engine revolutions calculated by the target engine revolution calculating means, wherein the propulsion force control means controls the propulsion forces of the propulsion units by controlling the intake air amounts of the internal combustion engines by means of the intake air amount control section based on the target openings calculated by the target opening calculating means.

5. The controller of claim 1 in combination with a boat controller for controlling the operation of the boat.

6. The controller of claim 2 in combination with a boat controller for controlling the operation of the boat.

7. The controller of claim 3 in combination with a boat controller for controlling the operation of the boat.

8. The controller of claim 4 in combination with a boat controller for controlling the operation of the boat.

9. A program for controlling a propulsion unit controller for controlling multiple propulsion units on a boat, at least one propulsion unit provided at the port stern and at least one unit provided at the starboard stern of the boat, wherein a computer implements a process using a target moving direction information acquiring means for acquiring target moving direction information of the boat, a target moving speed information acquiring means for acquiring target moving speed information of the boat, a target bow direction information acquiring means for acquiring target bow direction information of the boat wherein the target bow direction can be different than the target moving direction, a moving direction information detecting means for detecting current moving direction information of the boat, a moving speed information detecting means for detecting current moving speed information of the boat, a bow direction information detecting means for detecting current bow direction information of the boat, a geometric information acquiring means for acquiring geometric information of the boat and the propulsion units, a target control value calculating means for calculating target propulsion forces and target steering angles for the propulsion units so that the boat moves at the target moving speed in the target moving direction based on the target moving direction information, the target moving speed information, the target bow direction information, the moving direction information, the moving speed information, the bow direction information, and the geometric information, with the bow directed in the target bow direction which is different than the target moving direction, and a propulsion unit control means for controlling the propulsion units based on the target propulsion forces and the target steering angles calculated by the target control value calculating means.

10. A method of controlling a propulsion unit controller for controlling propulsion units, at least one unit provided at the port stern and at least one unit provided at the starboard stern of a boat, the method comprising the steps of acquiring a target moving direction of the boat, acquiring a target moving speed of the boat, acquiring a target bow direction of the boat, detecting a current moving direction of the boat, detecting a current moving speed of the boat, detecting a current bow direction of the boat, acquiring geometric information of the boat and the propulsion units, calculating target control values, the target propulsion forces and the target steering angles, of the propulsion units so that the boat moves at the target moving speed in the target moving direction based on the target moving direction, the target moving speed, the target bow direction, the current moving direction, the current moving speed, the current bow direction, and the geometric information, with the bow directed in the target bow direction which is different from the target moving direction, and controlling the propulsion units based on the target propulsion forces and the target steering angles calculated in the step of calculating the target control values.

11. A controller for a propulsion unit on a boat for controlling propulsion units, at least one provided at the port stern and at least one provided at the starboard stern of the boat, the controller comprising a target moving direction acquiring device configured to acquire a target moving direction of the boat, a target moving speed information acquiring device configured to acquire a target moving speed of the boat, a target bow direction information acquiring device configured to acquire a target bow direction of the boat, a moving direction information detecting device configured to detect a current moving direction of the boat, a moving speed information detecting device configured to detect a current moving speed of the boat, a bow direction information detecting device configured to detect a current bow direction of the boat, a geometric information acquiring device configured to acquire geometric information of the boat and the propulsion units, a target control value calculating device configured to calculate target propulsion forces and target steering angles for the propulsion units based on the target moving direction information, the target moving speed information, the target bow direction information, the moving direction information, the moving speed information, the bow direction information, and the geometric information, so that the boat moves at the target moving speed in the target moving direction with the bow directed in the target bow direction which is different from the target moving direction, and a propulsion unit control device configured to control the propulsion units based on the target propulsion force and the target steering angle calculated by the target control value calculating device.

12. The controller of claim 11, wherein the geometric information includes at least one of:

a distance between the boat stern and the instantaneous center of the boat;

distances between the center line and the respective propulsion units at the port and starboard; and numerical values related to the distances.

13. The controller of claim 11, wherein the propulsion unit is provided with an internal combustion engine, the propulsion unit control device including an intake air amount control section having a throttle valve being configured to control the intake air amount of the internal combustion engine by controlling the opening of the throttle valve, the controller further comprising a target engine revolution calculating device for calculating target engine revolutions of the port and starboard propulsion units respectively based on the target propulsion forces calculated by the target control value calculating device, and a target opening calculating device for calculating the target openings of the throttle valves of the port and starboard propulsion units respectively based on the target engine revolutions calculated by the target engine revolution calculating device, wherein the propulsion force control device controls the propulsion forces of the propulsion units by controlling the intake air amounts of the internal combustion engines with the intake air amount control section based on the target openings calculated by the target opening calculating device.

14. The controller of claim 11 in combination with a boat controller for controlling the operation of the boat.

15. The controller of claim 1, wherein the target control value calculating means is configured to provide target propulsion force and the target steering angle control values to the propulsion unit control means that cause the boat to move in a target moving direction that is in a different directional quadrant than the target bow direction.

16. The program according to claim 9, wherein the program is configured to maintain the target moving direction of the boat and the target bow direction such that the target moving direction of the boat can be in a different directional quadrant than the target bow direction of the boat.

17. The method according to claim 10, wherein the target bow direction is in a different directional quadrant than a directional quadrant of the target moving direction of the boat.

18. The controller of claim 11, wherein the target control value calculating device is configured to provide target propulsion force and the target steering angle control values to the propulsion unit control device that cause the boat to move in a target moving direction that is in a different directional quadrant than the target bow direction.

* * * * *

UNITED STATES PATENT AND TRADEMARK OFFICE

CERTIFICATE OF CORRECTION

PATENT NO. : 7,416,458 B2
APPLICATION NO. : 11/126872
DATED : August 26, 2008
INVENTOR(S) : Masaru Suemori et al.

It is certified that error appears in the above-identified patent and that said Letters Patent is hereby corrected as shown below:

In Column 6, Line 11, please delete "configures" and insert -- configured --, therefor.

In Column 8, Line 23, before "100", please insert -- Gz of the boat --.

In Column 8, Line 24, after "Gy", please insert -- of the boat --.

In Column 8, Line 34 (approx.), after "in", please delete "the".

In Column 8, Lines 52-55 (approximately), after "δR0.", please delete "Assuming the angle between the X-axis and the motion direction of the boat 100 in translation motion to be β [degrees], tan β can be expressed as follows using the above equations (1) and (2):" and insert the same as a new paragraph on Column 8, Line 53 (approx.).

In Column 10, Line 8, please delete "motor.3" and insert -- motor 3 --, therefor.

In Column 11, line 54, please delete "I" and insert -- 1 --, therefor.

In Column 13, Line 24, please delete "406." and insert -- S406. --, therefor.

In Column 14, Line 1, please delete "v=-30" and insert -- ψ=-30 --, therefor.

In Column 14, Line 2, please delete "y," and insert -- ψ, --, therefor.

In Column 14, Line 65, please delete "standard" and insert -- starboard outboard --, therefor.

In Column 15, Line 5, after "port", please insert -- and --, therefor.

In Column 15, Line 13, please delete "v" and insert -- ψ --, therefor.

In Column 16, Line 25 (approx.), in Claim 2, please delete "of" and insert -- of: --, therefor.

Signed and Sealed this

Sixteenth Day of March, 2010

David J. Kappos

David J. Kappos
*Director of the United States Patent and Trademark Office*